United States Patent [19]

Clark

[11] 4,026,521

[45] May 31, 1977

[54] STEEL STAPLE REMOVER

[76] Inventor: Don A. Clark, 3765 Fieldcrest Drive, Montgomery, Ala. 36111

[22] Filed: June 4, 1976

[21] Appl. No.: 692,719

[52] U.S. Cl. ..... 254/28

[51] Int. Cl.[2] ..... B25C 11/00

[58] Field of Search ..... 254/28, 131; 81/3 R, 81/9.5 R, 15.4, 15.6; 29/267

[56] References Cited

UNITED STATES PATENTS

| | | | |
|---|---|---|---|
| 590,607 | 9/1897 | Young | 81/15.6 |
| 1,043,369 | 11/1912 | Smith | 81/3 R |
| 1,555,282 | 9/1925 | Hein | 81/15.6 |
| 1,973,846 | 9/1934 | Crofoot | 254/28 |
| 2,842,017 | 7/1958 | Watson | 81/9.5 R |
| 2,945,407 | 7/1960 | Beltrani | 81/3 R |
| 3,825,226 | 7/1974 | Appleman | 254/28 |

*Primary Examiner*—Al Lawrence Smith
*Assistant Examiner*—Robert C. Watson
*Attorney, Agent, or Firm*—Joseph E. Rusz; Arsen Tashjian

[57] ABSTRACT

A hand tool for aiding in the removal of heavier, steel type staples normally used for binding a relatively large number of pages together including a handle with a steel tube having a uniquely shaped working end extending therefrom to allow it to be inserted under the bent end portions of a U-shaped clinched staple and pivoted upward causing bent portions of the staple to straighten thereby allowing the stapled work to be more easily separated.

3 Claims, 1 Drawing Figure

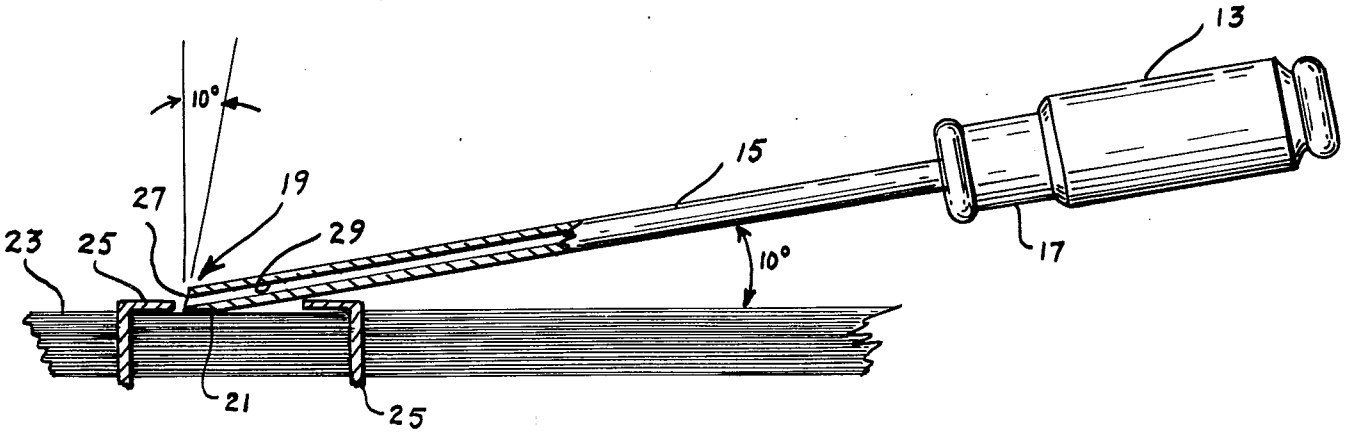
13
17
15
10°
25
29
19
21
10°
27
25
23

STEEL STAPLE REMOVER

STATEMENT OF GOVERNMENT INTEREST

The invention described herein may be manufactured and used by or for governmental purposes without the payment of any royalty thereon.

BACKGROUND OF THE INVENTION

This invention relates to a staple remover and, more particularly, the invention is concerned with providing a hand tool for aiding in the removal of heavy steel staples from sheets of material that have been secured together with relative ease and without causing damage to the material.

There are many presently available manually operable devices for removing wire staples from material where the legs have been clinched or bent over the material. Most of these devices work satisfactorily for the conventional wire staple which is light in weight and which can be drawn up through the stapled material with relative ease without substantially damaging the material. The bent legs of the staple partially straighten as the remover device is squeezed causing the staple to be released from the material. However, when heavy steel staples are used to bind sheets of material together, the conventional type of staple remover will not operate properly because of the relatively large forces required to straighten the bent legs of a steel staple by pulling upward through the work. Even if a heavy pry type staple remover were used, the results would not be satisfactory because there would likely be considerable damage to the sheets caused by the partially straightened legs of the steel staple as it is drawn through the material.

The only completely satisfactory way of removing a heavy steel staple which has been clinched and holds together sheets of material is to first straighten the bent legs and then pull the staple from the work or, alternately, separate the pages from the staple. Since steel staples are very stiff and difficult to manipulate, their removal is a difficult and frustrating task. A typical and very unsatisfactory as well as dangerous way of straightening the bent legs is by prying with a letter opener or penknife. It would be most desirable to provide a safe and simple way to straighten the legs on the clinched steel staple and thereby allow it to be easily removed from the stapled material.

SUMMARY OF THE INVENTION

The present invention is concerned with providing a hand tool for expeditiously removing a heavy steel staple which has been forced through layers of material and clinched by straightening the bent legs of the staple prior to withdrawing it from the work. The end of a length of steel tubing is shaped in such a way as to allow it to be inserted under the bent leg of the steel staple so that it can be rebent to the vertical position. The staple can then be easily removed from the work or, alternatively, the layers of material can be separated from each other by removing them from the staple. Also, if desired, the steel tube can be moved back and forth a few times to cause the legs of the staple to break off making separation of the material still easier.

Accordingly, it is an object of the invention to provide a hand tool suitable for aiding in the removal of heavy steel staples by allowing the bent legs of the clinched staple to be straightened in a simple and easy manner.

Another object of the invention is to provide a steel staple remover for more easily separating the pages of a bound publication by inserting the shaped end of the tool under the bent leg of the staple and pivoting the tool upward until the staple leg is straightened.

Still another object of the invention is to provide a staple remover device which will allow the heavy steel staple to be removed without causing damage to the stapled material and without danger of injury to the fingers of the person removing the staple.

A further object of the invention is to provide a device suitable for aiding in the removal of heavy steel staples which includes a tubular steel member having a sharpended end with an angular surface along the longitudinal axis thereof for contacting the work surface and sliding under the bent leg of the clinched staple.

A still further object of the invention is to provide a staple remover suitable for use with heavy steel staples which is simple and positive in action and easily handled by inexperienced personnel.

Another still further object of the invention is to provide a simple hand tool which will aid in the removal of heavy steel staples of a great variety of sizes and which can also be used to break off the bent legs of the staples if desired.

These and other objects, features, and advantages will become more apparent after considering the following detailed description in conjunction with the annexed drawings and appended claims.

BRIEF DESCRIPTION OF THE DRAWING

The drawing is a view in side elevation of the heavy steel staple remover tool according to the invention showing the steel tube in position for engagement with the bent leg of a clinched staple.

DESCRIPTION OF A PREFERRED EMBODIMENT

Referring now to the drawing, the steel staple remover tool according to the invention includes a handle portion 13 and a shank portion 15. The handle portion 13 may be cylindrical in configuration such as one commonly employed on screw drivers or like hand tools. A recessed area 17 is included in the handle portion 13 for positioning the thumb of the user therein to prevent slippage and to make the device more comfortable during extended usage.

The shank portion 15 which projects from the forward end of the handle 13 preferably is made of steel and may be fabricated of high strength steel tubing such as stainless steel. The shank portion 15 terminates in a shaped staple engaging and straightening end 19 which includes an angular contact surface 21 along the lower surface of the shank 15 in the region where it contacts the work surace 23. This angular configuration 21 forms a flat surface at the lower forward end of the tool terminating in a sharp edge so that it can be slipped under the staple 25 between the clinched end thereof and the work surface 23. To further facilitate the engagement of the staple engaging end 19 and the staple 25, a relief angle 27 is applied on the surface of the terminal end of the shank 15. The angular contact surface 21 may be approximately ten degrees from the horizontal and the relief angle 27 should also be approximately ten degrees back from the vertical. For example, if the shank 15 were fabricated of steel tubing with an outer diameter of three-sixteenth of an inch, the top forwardmost edge thereof would taper back about one-eight inch.

In operation, the device is grasped by the operator by means of the handle 13 with the thumb in the recessed area 17. The staple engaging end 19 of the shank portion 15 is positioned with the angular configuration 21 flat against the work surface 23 with the hollow portion 29 of the shank 15 in line with one of the clinched ends of the staple 25. The device is then pushed so that the sharpened edge formed by the angular configuration 21 slides under the clinched end of the staple 25 causing it to enter the hollow portion 29 of the shank 15. The handle 13 is then lifted until the device and the clinched end of the staple 25 are in the vertical position. The other clinched end of the staple 25 is straightened in the same manner. The stapled pages can then be easily separated without causing damage to the work and/or without subjecting the operator to dangers present when using makeshift tools such as a letter opener or pen knife.

From the foregoing description it can be seen that the steel staple remover herein disclosed is relatively simple and inexpensive to manufacture requiring only commonly used material and manufacturing procedures. For example, although the shank portion 15 has been shown and described as tubular material, it is obvious that it could also be fabricated of a solid steel rod with a hole drilled along its longitudinal axis of sufficient diameter and depth to accommodate the end of the staple 25 in its terminal end. Also, it should be noted that, if desired, the operator, after causing the end of the staple 25 to enter the hollow portion 29, could move the handle 13 in a back-and-forth motion and break off the clinched end of the staple 25 making separation of the pages even easier.

Although the invention has been illustrated in the accompanying drawing and described in the foregoing specification in terms of a preferred embodiment thereof, the invention is not limited to this embodiment or to the particular configuration disclosed. It will be apparent to those skilled in the art that certain changes, modifications and substitutions can be made, particularly with respect to the construction details, without departing from the true spirit and scope of the appended claims.

Having thus set forth the nature of my invention, what I claim and desire to secure by Letters Patent of the United States is:

1. In combination, a heavy steel clinched staple and a hand tool for aiding in the removal of same from a workpiece having a large number of sheets of material held together by the staple, said hand tool comprising a handle portion at one end, a shank portion extending outwardly from said handle and terminating in a shaped staple engaging end, said shank being tubular in configuration at its terminal end, and an angular contact surface extending along the lower surface at the terminal end of said shank for contacting the surface of the workpiece with the clinched end of the staple in alignment with the tubular terminal end of the shank to allow the clinched staple end to enter said shank when the lowermost portion of the shank end is positioned on the workpiece and thrust inward between the workpiece and the staple end whereby a lifting of said handle will cause the clinched staple end to be straightened.

2. The combination defined in claim 1 wherein the angular contact surface extending along the lower surface at the terminal end of the shank makes an angle of 10° from the horizontal with the axis of said shaft.

3. The combination defined in claim 2 wherein a relief angle of 10° from the vertical is applied on the surface of the terminal end of said shank.

* * * * *